United States Patent [19]

Maughan

[11] 4,037,777

[45] July 26, 1977

[54] HANDHOLE CLOSURE FOR CONTAINERS

[75] Inventor: William G. Maughan, Clifton Forge, Va.

[73] Assignee: Westvaco Corporation, New York, N.Y.

[21] Appl. No.: 696,381

[22] Filed: June 15, 1976

[51] Int. Cl.[2] ..... B65D 5/46; B65D 25/22

[52] U.S. Cl. ..... 229/52 B; 229/34 R

[58] Field of Search ..... 229/52 B, 34 R, 37 R, 229/38

[56] References Cited

U.S. PATENT DOCUMENTS

| | | | |
|---|---|---|---|
| 2,097,433 | 11/1937 | Clark et al. | 229/52 B X |
| 2,703,197 | 3/1955 | Brasch | 229/37 |
| 2,954,914 | 10/1960 | Herlihy | 229/52 B X |
| 3,143,275 | 8/1964 | Diggs | 229/52 B |
| 3,197,110 | 7/1965 | Neuman et al. | 229/38 |
| 3,547,337 | 12/1970 | Pisarczuk | 229/52 B X |
| 3,580,475 | 5/1971 | Mobley | 229/34 R |
| 3,788,538 | 1/1974 | Kuenzi | 229/52 B X |

*Primary Examiner*—Davis T. Moorhead

[57] ABSTRACT

A container having conventional top and bottom closure flaps, and side and end walls is provided with handhole cutouts in the end walls thereof and an integral means for reinforcing the handholes and for shielding the contents of the container from the ingress of light or contamination through the handhole cutouts. The integral means comprises a pair of panels which are cut from the conventional top minor closure flaps of the container so as not to eliminate the top minor closure flaps from their normal function as load supporting members for the top major closure flaps of the container.

1 Claim, 3 Drawing Figures

HANDHOLE CLOSURE FOR CONTAINERS

BACKGROUND OF THE INVENTION

The present invention relates to an improvement in containers having handhole cutouts and more particularly to containers with handholes that are used to package products which need to be shielded from light and/or contamination from the outside environment.

The conventional slotted container generally has four side walls (a pair of spaced side walls and a pair of spaced end walls) with closure flaps at both the bottom and top of the sidewalls. The top closure flaps are commonly known as major flaps (attached to the side walls of the container) and minor flaps (attached to the end walls of the container). Where the container is of the type that is handled by hand, generally the end walls contain handhole cutouts which may or may not have the material within the cutout remaining so as to provide a temporary closure for the cutout. Normally, however, the cutouts are stripped out and then additional material must be added to the container blank to cover and reinforce the handhole opening. One method of accomplishing the above noted result is to use the conventional top closure minor flaps of a regular slotted container. Two examples of this technique are fully disclosed in U.S. Pat. No. 2,097,433 and 3,197,110. However, as will be readily noted from studying these two patents, use of the minor top closure flaps for such a purpose eliminates the flaps from their primary purpose of providing support for the top major closure flaps. U.S. Pat. No. 2,703,197 shows another alternative construction for the stated purpose wherein only a portion of the top minor flaps are cut away. However in the latter patent, the cut away portions of the top minor flaps only serve to reinforce the handhole opening without providing any shielding function. Accordingly, it is a primary object of the present invention to provide both a handhole reinforcement and shielding means for a container without using a separate piece of material and without eliminating the normal function of the top minor closure flap members.

SUMMARY OF INVENTION

The present invention relates in general to a container construction having handholes in the end walls thereof. More particularly, the invention relates to a means for reinforcing the handhole cutouts of a container and for shielding the cutouts to prevent the ingress of light, dirt or other foreign material into the container. The invention is carried out by providing an integral means on the container blank which does not require extra material and which does not sacrifice the normal function or purpose of any of the various elements of the container. For this purpose, the container blank is provided with conventional top minor closure flaps each of which includes a portion cut therefrom to provide a handhole reinforcing panel, which reinforcing panels each further include portions cut therefrom that lock into the handhole cutouts for shielding the contents of the container from contamination through the cutouts.

DETAILED DESCRIPTION

Figure 1:
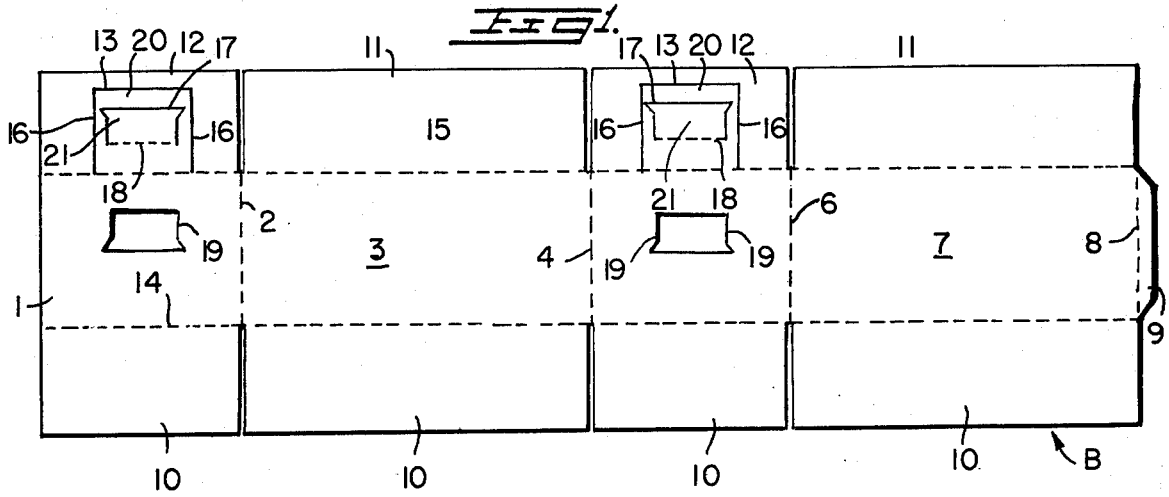
FIG. 1 is a top plan view of a one piece blank B embodying the present invention and showing handhole reinforcing and shielding panels formed from portions of the top end closure flaps.

Referring more particularly to the drawing it may be seen that the invention comprises a container C that is folded from a blank B having foldably connected side walls 1, 3, 5 and 7 attached to one another along fold lines 2, 4, and 6. Foldably connected to the bottom edge of each side wall are a plurality of bottom closure flaps 10 attached along a fold line 14, and at the top edge of each of the side walls, there is connected a pair of side wall closure flaps 11 and a pair of end wall closure flaps 12 attached along a fold line 15. The basic blank structure B is completed with a manufacturers closure flap 9 foldably attached along a fold line 8 to side wall 7 and a pair of handhole cutouts 19, one in each end wall 1 and 5. In the preferred embodiment, the handhole cutouts 19 are completely punched out as shown, but if desired, the handholes 19 may be cut only along the ends and lower edges thus providing an additional integral handhole flap (not shown) hingedly secured along the upper edge of each handhole 19.

Figure 2:
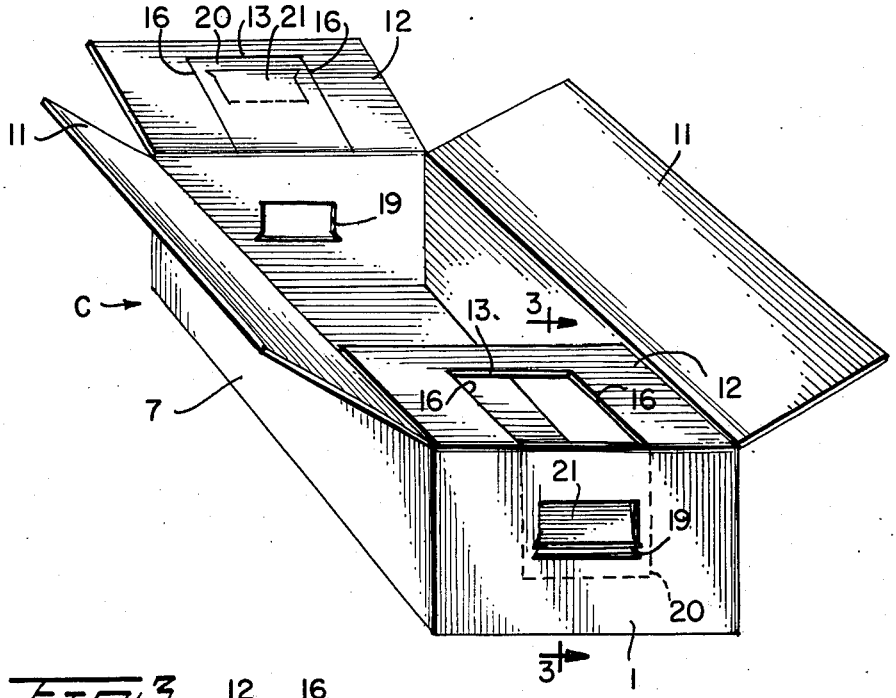
FIG. 2 is a perspective view of a container as formed from the blank of FIG. 1 showing one of the handhole reinforcing and shielding panels folded down and locked in place; and, FIG. 3 is a vertical cross section of the assembled container of FIG. 2 taken along the lines 3—3 of FIG. 2.
Figure 3:
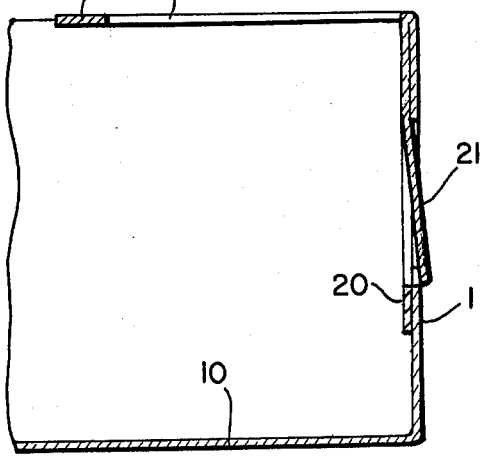

In any case, the novel feature of the present invention lies in the handhole reinforcing and shielding panels 20 that are cut from the top end closure flaps 12. As shown particularly in FIG. 1, it may be seen that each panel 20 is formed by an outer edge 13 that lies wholly within the flap 12 and a pair of end edges 16 which extend substantially perpendicularly from the ends of edge 13 to the fold line 15 for flap 12. Thus, each of the flaps 12 and panel 20 have a common foldable connection to the end walls 1 and 5. This arrangement permits the panels 20 to be folded inside the container in the set up condition without eliminating entirely the functional utility of the top end closure flaps 12. Further, the panels 20 are sized so as to be slightly larger than the handhole cutouts 19 in end walls 1 and 5 so that handhole shielding flaps 21 may be cut from the panels 20. As shown in FIG. 1, the handhole shielding flaps 21 are of a similar shape and size to the cutouts 19 and are formed by end edges 17 and connecting side edges which are foldably attached to the panels 20 along fold lines 18. Thus, as shown in FIG. 2, once a panel 20 is folded inside the assembled container C to lie next to the adjacent end wall 1 or 5, the handhole shielding flap 21 is forced into the cutout 19 with a friction fit. The frictional engagement of flap 21 in cutout 19 keeps the panel 20 in place until such time that the container is filled. Subsequently, when the container is filled, the remaining portions of top closure flaps 12 are folded over in the conventional manner before flaps 11 are folded and the container is either taped, stapled or glued.

Accordingly it may be seen that the container of the present invention includes a novel arrangement of parts which are used in a substantially normal functional relationship, but which still provide an integral handhole reinforcing means and handhole shielding means. Further, while only one embodiment of the invention has been fully disclosed, it is to be understood that obvious changes in the invention may be made within the scope of the appended claims.

I claim:

1. In a container having a pair of end walls and a pair of side walls, bottom closure flaps foldably connected to the lower edges of said walls and top closure flaps comprising a pair of major flaps foldably connected to the upper edges of said side walls and a pair of minor flaps foldably connected to the upper edges of said end walls, the improvement comprising handhole cutouts in each of said end walls with integral means for reinforcing said handhole cutouts and for shielding the entry of light and contamination into said container through said handhole cutouts, said integral means comprising a pair of reinforcing panels formed in said minor top closure flaps each of said reinforcing panels having an outer edge and two side edges wholly cut from a minor top closure flap and a foldable connection along an end wall that is common to the foldable connection between said end wall and minor top closure flap and a pair of handhole shielding flaps formed in each of said reinforcing panels, said shielding flaps each having an outer edge and two side edges wholly cut from a reinforcing panel and a foldable connection with said reinforcing panel that is parallel to and offset from the foldable connection between each reinforcing panel and end wall, wherein said reinforcing panels are adapted to be folded inside said container to lie adjacent the respective end walls and said handhole shielding panels are adapted to be engaged within the handhole cutouts in the perspective end walls.

* * * * *